US005096321A

United States Patent [19]

Mountain

[11] Patent Number: 5,096,321

[45] Date of Patent: Mar. 17, 1992

[54] FOUNTAIN TOOTHBRUSH

[76] Inventor: Edward F. Mountain, 26 Gardenir St., Lynn, Mass. 01905

[21] Appl. No.: 745,861

[22] Filed: Aug. 16, 1991

[51] Int. Cl.[5] ..... A46B 11/02

[52] U.S. Cl. ..... 401/149; 401/150; 401/176; 401/286

[58] Field of Search ..... 401/146, 176, 149, 150, 401/286

[56] References Cited

U.S. PATENT DOCUMENTS

| | | |
|---|---|---|
| 1,711,183 | 4/1929 | Smith . |
| 1,944,067 | 1/1934 | Collins . |
| 2,308,078 | 1/1943 | Hendrickson . |
| 3,864,047 | 2/1975 | Sherrod . |
| 3,937,235 | 2/1976 | Broughton . |
| 4,408,920 | 10/1983 | Walther et al. . |
| 4,467,822 | 8/1984 | Blackwell . |
| 4,692,047 | 9/1987 | Endo . |
| 4,733,983 | 3/1988 | Hertrampf . |

FOREIGN PATENT DOCUMENTS

| | | | |
|---|---|---|---|
| 523340 | 4/1956 | Canada | 401/150 |
| 2598300 | 5/1986 | France | 401/176 |

*Primary Examiner*—Steven A. Bratlie

*Attorney, Agent, or Firm*—Fleit, Jacobson, Cohn, Price, Holman & Stern

[57] ABSTRACT

A fountain toothbrush is provided including a bristle tufted end and a handle end and an elongated toothpaste reservoir also is provided including opposite ends selectively supportively engagable with the handle end of toothbrush. The handle of the toothbrush is equipped with a manually actuatable pump for pumping toothpaste from the handle end, through the handle and into a predetermined area between adjacent bristle tufts of the toothbrush. In a first position of the reservoir the pump is operable to withdraw toothpaste from the reservoir and pump the toothpaste to the bristle end of the brush and in a second position of the reservoir the latter is operable to receive a renewal supply of toothpaste from a collapsible toothpaste tube.

9 Claims, 2 Drawing Sheets

FOUNTAIN TOOTHBRUSH

BACKGROUND OF THE INVENTION

1. Field of the Invention

This invention relates to a fountain toothbrush including a removable toothpaste reservoir supported from the handle end of the toothbrush remote from the bristles thereof, which handle end includes a manually actuatable pump operative to pump toothpaste from the reservoir through an internal passage in the toothbrush handle for discharge between the bristle tufts of the toothbrush.

2. Description of Related Art

Various different forms of fountain toothbrushes heretofore have been provided such as those disclosed in U.S. Pat. Nos. 1,711,183, 1,944,067, 2,308,078, 3,864,047, 3,937,235, 4,408,920, 4,467,822, 4,692,047 and 4,733,983. However, these previously known forms of fountain toothbrushes include either a squeezeable toothpaste reservoir, a pumping system which is difficult to operate after having initially placed the toothbrush in the user's hand or a pumping system which incorporates an excessive number of parts and increases the cost of manufacture thereof. Further, these previously known forms of fountain toothbrushes also do not include structure which enables the toothpaste reservoir thereof to be readily refilled from a conventional collapsible tube of toothpaste.

SUMMARY OF THE INVENTION

The fountain toothbrush of the instant invention includes only three major components including a closure cap for covering the pump portion and bristle portion of the toothbrush and three minor components consisting of a pump plunger, a return spring and a reservoir piston.

By providing a fountain toothbrush including such a minimal number of components and wherein all of the components of the toothbrush (exclusive of the bristle tufts thereof) may be manufactured of plastic by conventional molding methods, a fountain toothbrush is provided which may be manufactured in a very economical manner.

The main object of this invention is to provide a fountain toothbrush which may be readily actuated to dispense toothpaste to the brush bristles thereof after the toothbrush has been positioned in the hand of the user for use by the user.

Another object of this invention is to provide fountain toothbrush including a toothpaste reservoir from which toothpaste may be pumped to the bristle area of the brush to through the utilization of a readily actuatable pump system including a minimum number of parts.

Still another important object of this invention is to provide a fountain toothbrush including a toothpaste reservoir into which toothpaste from a conventional collapsible tube of toothpaste may be readily dispensed.

Another important object of this invention is to provide a fountain toothbrush constructed in a manner whereby the toothbrush includes, exclusive of the bristle tufts thereof, only three major components and three ancillary components, all of which may be manufactured of plastic by conventional molding processes.

A final object of this invention to be specifically enumerated herein is to provide a fountain toothbrush in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
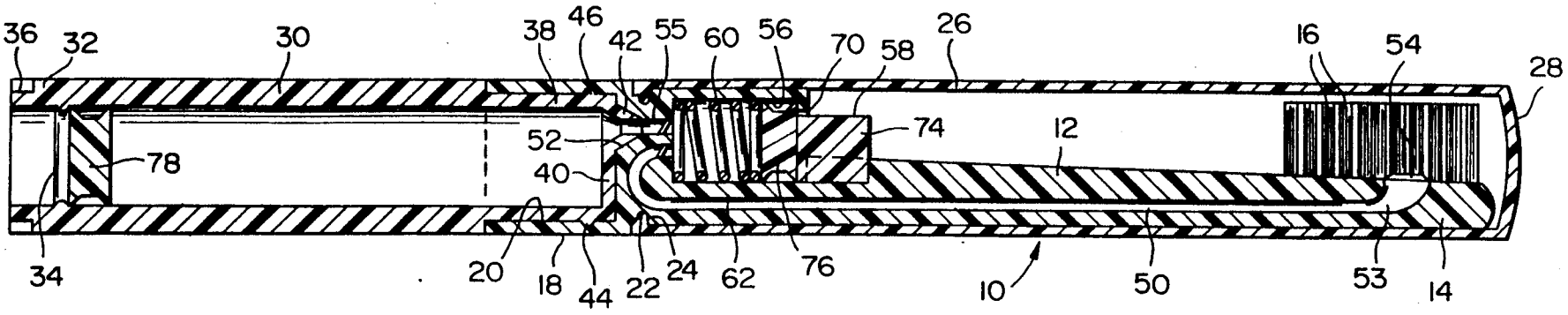
FIG. 1 is a longitudinal sectional view of the fountain toothbrush of the instant invention with the tubular cover portion thereof disposed over the handle of the toothbrush and the toothbrush reservoir thereof operatively removably connected to the end of the toothbrush handle remote from the toothbrush bristle end thereof.
Figure 2:
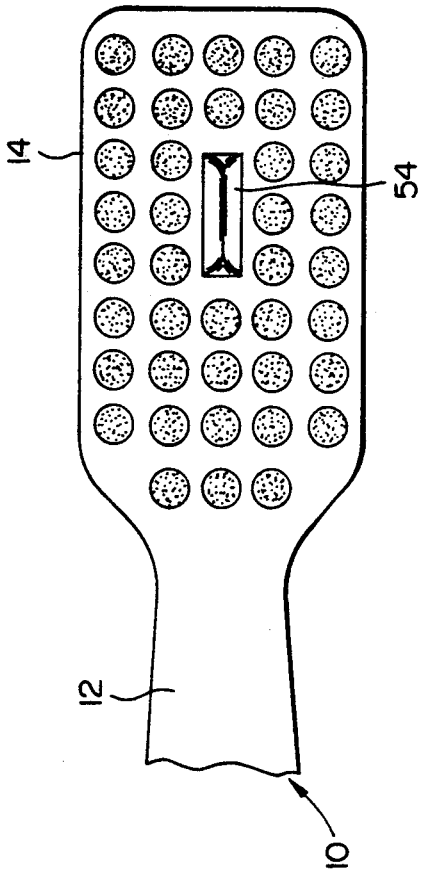
FIG. 2 is an enlarged fragmentary plan view of the bristle tuft end of the toothbrush illustrating the valve structure at the end of the toothbrush supply passage for discharging toothpaste into the bristle tuft area of the toothbrush.

Referring now more specifically to the drawings and to FIG. 1 in particularly, the numeral 10 generally designates the fountain toothbrush of the instant invention. The toothbrush 10 includes an elongated handle 12 having a first end 14 equipped with tufts 16 of bristles and a second end 18 defining an outwardly opening recess 20. The second end 18 includes a circumferential groove 22 extending thereabout in which an internal circumferential bead 24 of the open end of a tubular cover 26 is snap retentively engaged with the tubular cover 26 disposed over all but the second end of the handle 12, the cover 26 including a closed end 28 which encloses the bristle tufts 16.

The toothbrush 10 additionally includes a tubular reservoir 30 including one open end 32 including an internal circumferential rib 34 and an external circumferentially extending groove 36 opening axially outwardly of the one end 32. The other end 38 of the reservoir 30 includes a closure end wall 40 through which an outwardly projecting tubular nipple 42 opens and the second end 18 of the handle 12 includes an internal inwardly opening circumferential groove 44 in which an external circumferentially extending rib 46 on the other end 38 of the reservoir 30 is snap engagable when the other end 38 is snugly telescoped into the recess 20 defined in the second end 18 of the handle 12.

Figure 3:
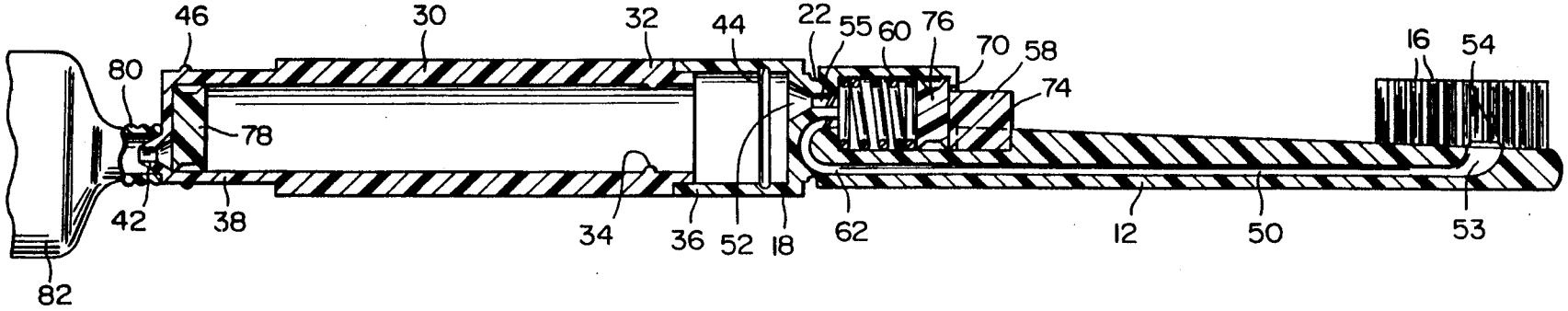
FIG. 3 is a longitudinal sectional view of the toothbrush similar to FIG. 1 but with the cover removed and the reservoir portion of the toothbrush in end-to-end reversed position for receiving toothpaste from the outlet neck of a conventional collapsible tube of toothpaste.
Figure 4:
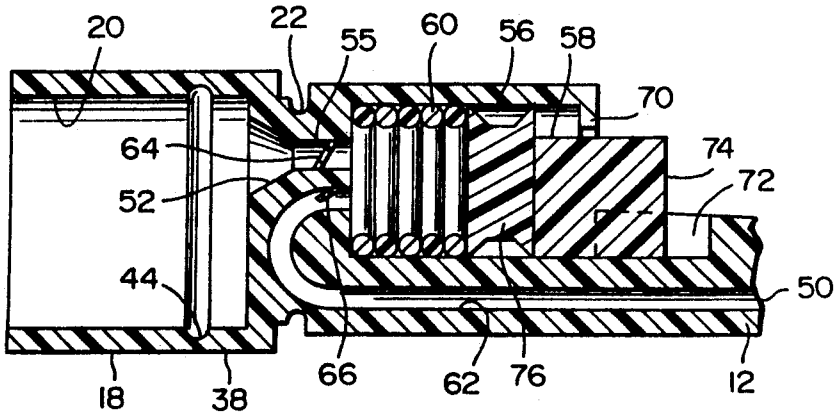
FIG. 4 is an enlarged fragmentary logitudinal sectional view illustrating the manually operable pump portion of the fountain toothbrush with its components in position at the end of the toothpaste pumping stroke thereof.

With attention now invited more specifically to FIGS. 3 and 4, it may be seen that the handle 12 includes a fluent material passage 50 extending lengthwise therethrough including one end 52 defining a socket into which the tubular neck 42 is sealing seated when the other end 38 of the reservoir 30 is engaged in the recess 20 of the second end 18 of the handle 12. The other end 53 of the passage 50 opens through a slit-type valve 54 generally centrally located between the bristle tufts 16, the slit-type valve 54 being constructed integrally with the handle 12.

Figure 5:
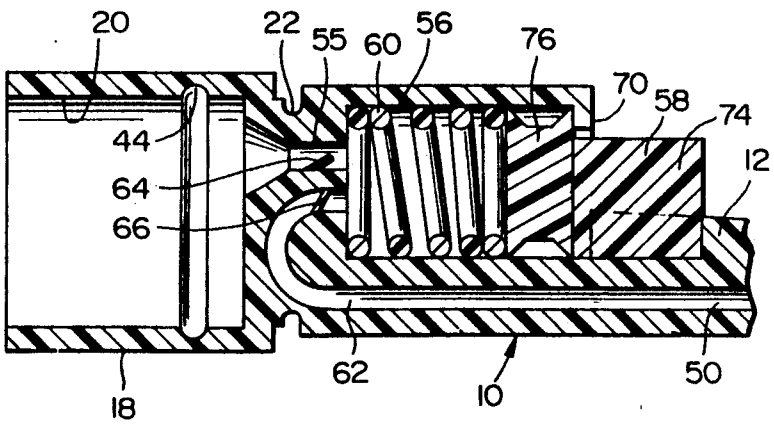
FIG. 5 is an enlarged fragmentary sectional view similar to FIG. 4 but with the components of the pump portion of the toothbrush in the positions thereof at the end of the return stroke thereof for drawing toothpaste into the pumping chamber prior to pumping of the toothpaste therefrom to the bristle tuft area of the toothbrush.

The socket 52 opens forwardly into a short passage section 55 of the passage 50 which in turn opens forwardly into a pump chamber 56 including a pump piston and plunger assembly 58 slidably disposed therein as well as a coiled compression spring 60 disposed therein. A long passage section 62 of the passage 50 opens rearwardly out of the pump chamber 56 and extends forwardly through the handle 12 to the slit-type valve 54, the socket 52, short passage section 55, pump chamber 56 and long passage section 62 all comprising parts of the passage 50. In addition, from FIGS. 4 and 5, it may be seen that the short passage section 55 includes an integral one-way flap valve 64 while the end of the long passage section 62 opening into the pump chamber 56 includes an integral one-way flap valve 66. The flap valve 66 is operative to allow toothpaste under pressure to flow through the long passage section 62 from the pump chamber 56 to the slit-type valve 54 and to prevent reverse flow of toothpaste through the long passage section 62 into the pump chamber 56. On the other hand, the flap valve 64 is operative to allow fluent material flow forwardly through the short passage section 55 and to prevent rearward fluent material flow through the short passage section 55. The forward end of the pump chamber 56 is partially closed by a stiff but bendable tab 70 formed integrally with the handle 12 and the handle 12 includes a guideway 72 formed therein in which the finger engagable portion 74 of the combined pump piston and plunger assembly 58 is slidably receivable. As hereinbefore indicated, the flap valves 64 and 66 are formed as integral portions of the handle 12 and the compression spring 60 and pump piston and plunger assembly 58 may be inserted within the pump chamber 56 through the forward end thereof by bending the tab 70 outwardly and upwardly sufficiently to first insert the coil spring 60 and to thereafter insert the piston portion 76 of the assembly 78 into the pump chamber 56 from the front end thereof.

In operation, and assuming that the fountain toothbrush 10 has its components operatively associated in the manner illustrated in FIG. 1 and that the interior of the reservoir 30 in front of the piston 78 therein is full of fluent toothpaste (not shown) the tubular cover 26 is removed and the pump piston and plunger assembly 58 is repeatedly displaced rearwardly and allowed to return forwardly under the biasing action of the spring 60 until fluent toothpaste is drawn into the pump chamber 56 and pumped therefrom through the passage 50 for discharge therefrom through the slit-type valve 54 into the area between the adjacent bristle tufts 16. Thereafter, the toothbrush 10 is utilized in the conventional manner and, after usage, the toothpaste remaining on the bristle tufts 16 is flushed therefrom and the tubular cover 26 is replaced.

Continued use of the toothbrush 10 will cause the piston 78 to move forward through the reservoir 30 until it contacts the closure end wall 40, at which time substantially all toothpaste within the reservoir 30 will have been consumed. At this time, the other end 38 of the reservoir 30 is withdrawn from the recess 20 and the end 30 is engaged within the recess 20 in the manner illustrated in FIG. 3 of the drawings. Then, the outlet neck 80 of a conventional collapsible toothpaste tube 82 is telescoped over the tubular nipple 42 and toothpaste is expressed from the tube 82 through the outlet neck 80, the tubular nipple 42 and into interior of the reservoir 30. As toothpaste is expressed from the tube 82 into the reservoir 30, the piston 78 will be forced away from the closure end wall 40 until such time as the piston 78 contacts the rib 34, at which time the reservoir 30 again will be filled with toothpaste. Then, the outlet neck 80 is removed from the tubular nipple 42 and the end 32 of the reservoir 30 is withdrawn from the recess 20, reversed in end-to-end relation and the other end 38 of the reservoir 30 is again telescoped into the recess 30 with the rib 46 snap engaged in the groove 44. Thereafter, the toothbrush 10 is again ready to be used until all of the toothpaste within the reservoir 30 has been pumped therefrom through the tubular nozzle 42.

The recess 20 and groove 46 comprise first coupling structure, the one end 32 and the groove 36 comprise second coupling structure and the other end 38 and rib 46 comprise a third coupling structure, the second and third coupling structures being alternately engagable with the first coupling structure for removable support of the corresponding reservoir end from the handle second end 18. In addition, the third coupling structure includes first fluent material transfer means comprising the tubular nipple 42 and the end of the passage 50 remote from the bristle tufts 16 includes second fluent material transfer means (socket 52) in which the first fluent material transfer means 42 is seated in at least reasonably sealed fluent material transfer engagement therewith when the third coupling structure is engaged with the first coupling structure.

The tubular cover, handle and reservoir 30 comprise three major components of the toothbrush which may be constructed of plastic by conventional molding processes, the handle 12 having the flap valves 64 and 66 molded integrally therewith. In addition, the compression spring 60 and piston pump and plunger assembly 58 also may be constructed of plastic by conventional molding processes. Thus, the entire fountain toothbrush 10 may be economically produced. Further, the fountain toothbrush 10 includes a minimum number of parts and, therefore, is highly dependable in operation.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fountain brush including an elongated handle having a first end including multiple brush tufts and a second end defining first coupling structure, said handle including a fluent material passage therein opening outwardly of said coupling structure at one end and outwardly of said handle between said tufts at the other end, an elongated, rigid tubular fluent material reservoir having second coupling structure at end and third coupling structure at the other end thereof, a piston disposed in said reservoir and sealing, slidingly shiftable therein between said second and third coupling structures, said second and third coupling structures being alternately engagable with said first coupling structure for removable support of the corresponding reservoir end from said handle second end in communication with said passage one end, said third coupling structure including first fluent material transfer means for removable fluent material transfer connection with a fluent material container outlet neck, said on end of said passage including second fluent material transfer means with which said first fluent material transfer means is disposed in at least reasonably sealed fluent material transfer engagement when said third coupling structure is engaged with said first coupling structure, said handle including manually actuatable pump means supported therefrom and serially connected in said fluent material passage between said one and other ends thereof operative to pump fluent material through said passage from said one end thereof to said other end thereof.

2. The fountain brush of claim 1 wherein said brush comprises a toothbrush.

3. The fountain brush of claim 1 wherein said manually actuatable pump means includes a pumping chamber and said passage includes a short passage section communicating said pumping chamber with said first coupling structure and a long passage section opening into said pumping chamber and outwardly between said brush tufts, said short and long passage sections each including one-way check valves disposed therein allowing fluent material flow from said first coupling structure into said pumping chamber and fluent material flow from said pumping chamber to said brush tufts.

4. The fountain brush of claim 3 wherein said one-way check valves comprise flap valves formed integrally with said handle.

5. The fountain brush of claim 1 including a tubular cover open at one end and closed at the other end, said one end being telescopingly engagable over said handle from the brush tufted end thereof and releasably engagable over the other end of said handle.

6. The fountain brush of claim 1 wherein said first fluent material transfer means includes a tubular nipple projecting outwardly of said other end of said reservoir and said second fluent material transfer means includes an outwardly flaring socket in which said tubular nipple is sealingly seated when said third coupling structure is engaged with said first coupling structure.

7. The fountain brush of claim 6 wherein said manually actuatable pump means includes a pumping chamber and said passage includes a short passage section communicating said pumping chamber with said first coupling structure and a long passage section opening into said pumping chamber and outwardly between said brush tufts, said short and long passage sections each including one-way check valves disposed therein allowing fluent material flow from said first coupling structure into said pumping chamber and fluent material flow from said pumping chamber to said brush tufts.

8. The fountain brush of claim 7 wherein said one-way check valves comprise flap valves formed integrally with said handle.

9. The fountain brush of claim 8 including a tubular cover open at one end and closed at the other end, said one end being telescopingly engagable over said handle from the brush tufted end thereof and releasably engagable over the other end of said handle.

* * * * *